US005813412A

United States Patent [19]

Okumoto

[11] Patent Number: 5,813,412

[45] Date of Patent: Sep. 29, 1998

[54] DEVICE FOR TRIMMING SHREDDED TOBACCO LAYER FORMED IN CIGARETTE MANUFACTURING MACHINE

[75] Inventor: Yutaka Okumoto, Tokyo, Japan

[73] Assignee: Japan Tobacco Inc., Tokyo, Japan

[21] Appl. No.: 864,912

[22] Filed: May 29, 1997

[30] Foreign Application Priority Data

May 29, 1996 [JP] Japan ..... 8-135068

[51] Int. Cl.[6] ..... A24C 5/39

[52] U.S. Cl. ..... 131/84.4; 131/83.3

[58] Field of Search ..... 131/84.4, 84.1, 131/84.2, 84.3, 83.1

[56] References Cited

U.S. PATENT DOCUMENTS 4,600,020 7/1986 Mattei et al. ..... 131/84.4

5,526,826 6/1996 Heitmann ..... 131/84.4

*Primary Examiner*—John G. Weiss

*Assistant Examiner*—Charles W. Anderson

*Attorney, Agent, or Firm*—Birch, Stewart, Kolasch & Birch, LLP

[57] ABSTRACT

A device for trimming a shredded tobacco layer in a cigarette manufacturing machine is provided with a pair of trimming disks rotatably arranged, and a peeling disk rotatably arranged under the trimming disks. The peeling disk has a peeling blade formed at the peripheral edge of the peeling disk for scraping surplus shredded tobacco off the shredded tobacco layer in cooperation with the trimming disks, and a flat end face for guiding the surplus shredded tobacco scraped off by the peeling blade.

4 Claims, 3 Drawing Sheets

DEVICE FOR TRIMMING SHREDDED TOBACCO LAYER FORMED IN CIGARETTE MANUFACTURING MACHINE

BACKGROUND OF THE INVENTION

1. Field of the Invention

The present invention relates to a device for trimming a shredded tobacco layer sucked on a suction band, thereby adjusting the thickness of the shredded tobacco layer when a tobacco rod is continuously formed in a cigarette manufacturing machine.

2. Description of the Related Art

A trimming device for a shredded tobacco layer has trimming disks rotatably arranged under a suction band of a cigarette manufacturing machine, and a rotary brush of metal which rotates while kept in contact with the lower surfaces of the trimming disks. The trimming disks and the rotary brush cooperate with each other to adjust a shredded tobacco layer sucked on the lower surface of the suction band to a predetermined thickness. More specifically, the shredded tobacco layer is adjusted to a thickness corresponding to a distance between the trimming disk and the suction band, and surplus shredded tobacco located under the trimming disks is removed by the rotary brush.

The rotary brush has a plurality of scraping fins which are disposed spaced apart from one another on the peripheral surface of the rotary brush. Each scraping fin has a blade at the tip thereof. As the rotary brush rotates, each blade periodically comes in contact with the lower surfaces of the trimming disks. Thus, a portion of the shredded tobacco layer which would otherwise pass under the trimming disks, that is, the surplus shredded tobacco is scraped off by the fins of the rotary brush. The scraped-off shredded tobacco is thereafter collected and reused to form a shredded tobacco layer.

Recently, traveling speed of the suction band, that is, transportation speed of the shredded tobacco layer tends to be more and more increased in order to enhance productivity in manufacturing tobacco rod by the cigarette manufacturing a machine. Under the circumstances, the rotary brush of the trimming device also needs to be rotated at high speed, in order to steadily adjust the thickness of the shredded tobacco layer.

When the rotation speed of the rotary brush is increased, the respective scraping fins beat the surplus shredded tobacco strongly, so that the scraped-off shredded tobacco is excessively broken into fragments. Thus, the collected shredded tobacco is too small in particle size to be reused.

SUMMARY OF THE INVENTION

The object of the present invention is to provide a trimming device for shredded tobacco capable of reducing the fragmentation of the shredded tobacco and suitable for high speed operation of the cigarette manufacturing machine.

The object is achieved by the present invention, a trimming device according to the present invention comprises: a trimming disk rotatably arranged in a vicinity of a suction band which forms and transports a shredded tobacco layer, the trimming disk continuously cutting into the shredded tobacco layer on the suction band during the rotation of the trimming disk, thereby dividing the shredded tobacco layer into a required layer portion and a surplus portion; and removing means for removing the surplus portion of the shredded tobacco layer in cooperation with the trimming disk.

The removing means includes a rotatable peeler disk having a peeling blade formed at a peripheral edge of the peeler disk to extend continuously in a peripheral direction thereof and arranged to move while keeping contact with a lower surface of the trimming disk, and a flat end face for guiding the removed surplus portion.

According to the trimming device as described above, the surplus portion of the shredded tobacco layer is removed by the peeling blade like peel is removed off. Further, the surplus shredded tobacco peeled off by the peeling blade is guided by the flat end face and discharged from the peripheral edge of the peeler disk. Therefore, the surplus shredded tobacco will not be subjected to an excessively large impact, and the fragmentation of the shredded tobacco is largely reduced. As a result, the rate of reuse of the surplus shredded tobacco collected is increased, and productivity of the cigarette manufacturing machine can be enhanced.

Specifically, the peeler disk further comprises a taper surface forming the periphery of the peeler disk and arranged to be in line contact with the lower surface of the trimming disk, and the peripheral edge of the large-diameter side of the taper surface is formed as the peeling blade. In this case, the shredded tobacco peeled off by the peeling blade is guided by the large-diameter end face of the peeler disk and discharged from the peripheral edge thereof.

The peeling blade is so arranged as to pass through the shredded tobacco layer, moving in the direction obliquely crossing the transportation direction of the shredded tobacco layer. In this arrangement, the peeling blade can easily cut into the shredded tobacco.

Furthermore, The taper surface of the peeler disk may be provided with a plurality of transverse recesses which are disposed equally spaced apart from one another in the peripheral direction of the peeler disk. In this case, even when the trimming disks have a plurality of pockets, the pockets do not interfere with the rotation of the peeler disk.

Further scope of applicability of the present invention will become apparent from the detailed description given herein after. However, it should be understood that the detailed description and specific example, while indicating preferred embodiment of the invention, are given by way of illustration only, since various changes and modifications within the sprit and scope of the invention will be become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
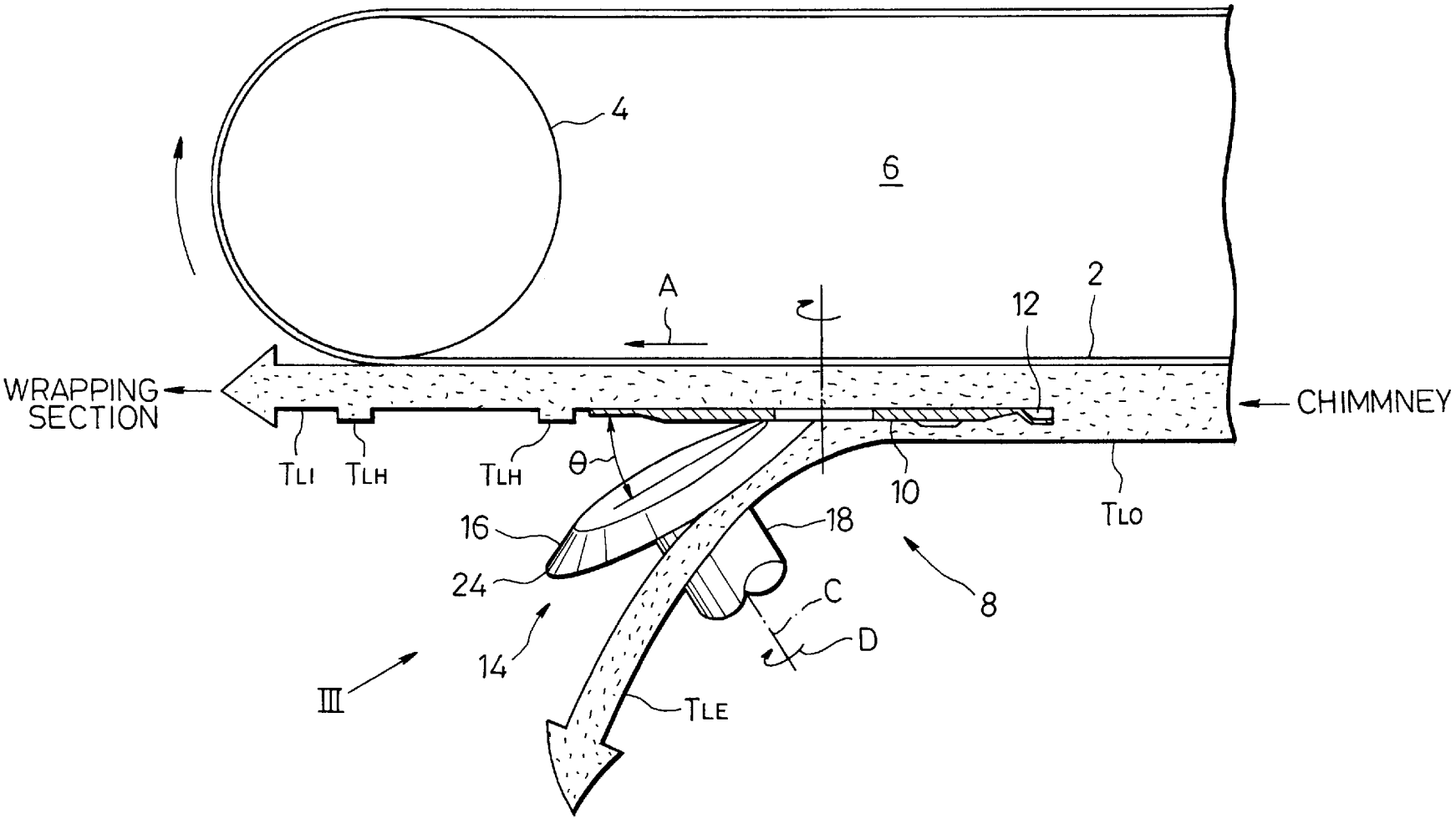
FIG. 1 is a schematic structural view showing a part of a cigarette manufacturing machine.

FIG. 1 shows a part of a cigarette manufacturing machine including a device for trimming a shredded tobacco layer. As known, the cigarette manufacturing machine is provided with an endless suction band 2, which is extended around a pair of band rollers 4. As the band rollers 4 rotate, the suction band 2 travels at a constant speed in the direction indicated by an arrow A in FIG. 1 within a perpendicular plane. It is to be noted that only one of the band rollers 4 is shown in FIG. 1.

The suction band 2 is disposed in a suction chamber 6. The suction chamber 6 generates an air flow flowing upward from under the suction band 2. At the side of the band roller a chimney (not shown) is provided directly under the suction band 2. Shredded tobacco supplied into the chimney is blown up with air by the sucking force of the suction chamber 6 and sucked onto the lower surface of the suction band 2 in the form of a layer. Thus, a shredded tobacco layer $T_{LO}$ is formed on the portion of the suction band 2 which has passed through the chimney. The shredded tobacco layer $T_{LO}$ is transported with the suction band 2, and then at the position of the band roller 4, taken off the suction band 2 by a shoe (a scraper) not shown and supplied on to paper in a wrapping section of the cigarette manufacturing machine.

Under the suction band 2 is provided a trimming device 8 in the vicinity of one of the band rollers 4. The trimming device 8 has a pair of trimming disks 10 disposed on the left and right sides of the suction band 2 relative to the traveling direction of the suction band 2. The Trimming disks 10 are made of metal and are disposed on the same horizontal plane. In FIG. 1, only an axis of a rotary shaft on which one of the trimming disks 10 is mounted is shown.

Figure 2:
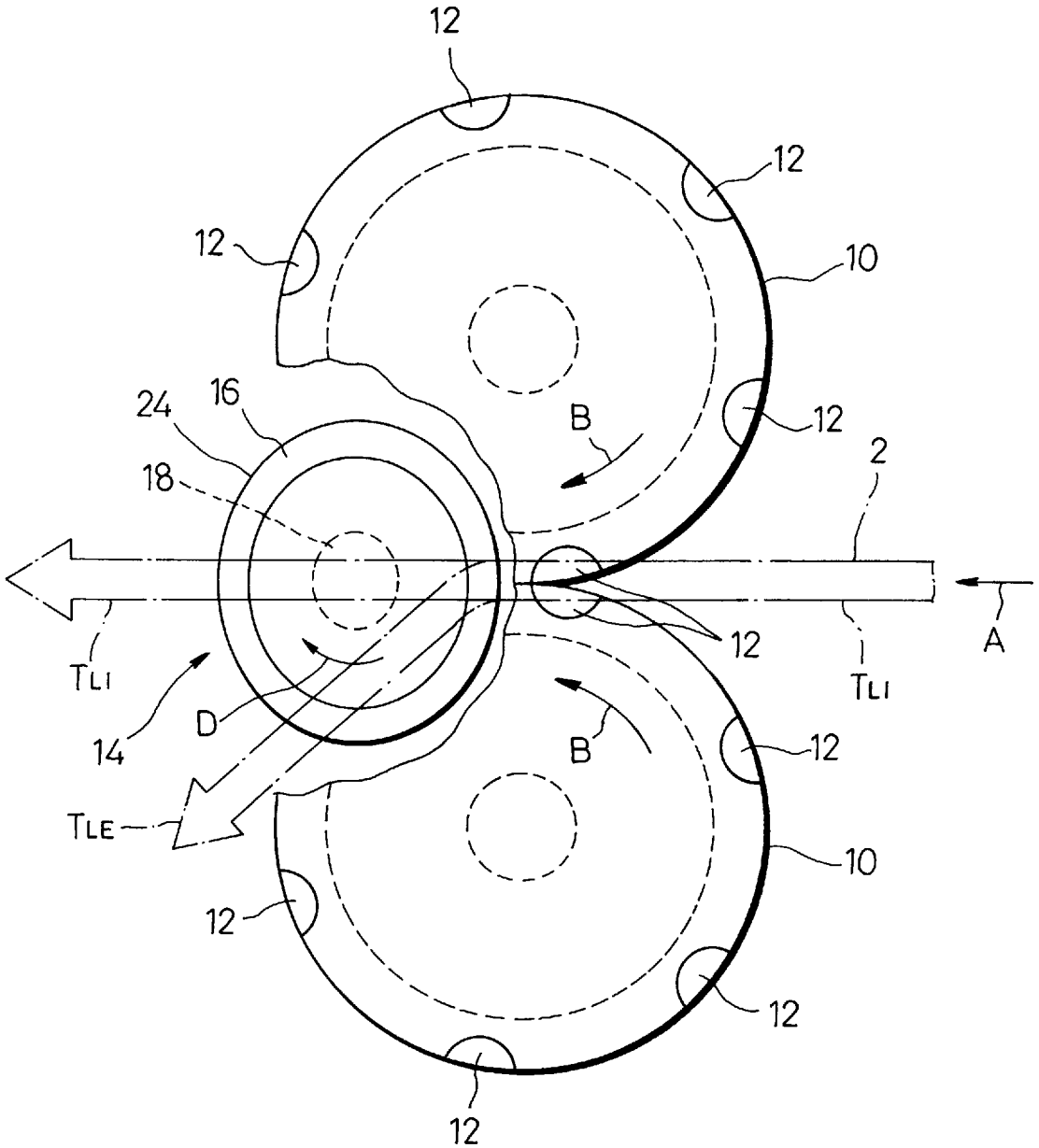
FIG. 2 is a view showing a positional relation of a pair of trimming disks and a peeler disk.

More specifically, as shown in FIG. 2, the pair of trimming disks 10 are disposed on both sides of the suction band 2, and the peripheral edge portions of the trimming disks 10 are close to each other under the suction band 2, with a perpendicular plane including a center line of the suction band 2 sandwiched between the peripheral edge portions of the trimming disks 10.

The pair of trimming disks 10 are rotated in opposite directions. The directions of their rotations are indicated by arrows B in FIG. 2. It is to be noted that after coming close to each other, the peripheral edge portions of the trimming disks 10 move in the same-direction with the transportation direction A of the aforementioned shredded tobacco layer $T_{LO}$.

The pair of the trimming disks 10 have a plurality of pockets 12 at their peripheral portions, respectively (FIG. 1). The pockets 12 are disposed equally spaced apart from one another in the peripheral direction of each trimming disk 10. It is so provided that while the pair of trimming disks 10 are rotating, each pocket 12 of one of the trimming disks 10 periodically meets a corresponding pocket 12 of the other trimming disk 10 under the suction band 2.

Figure 3:
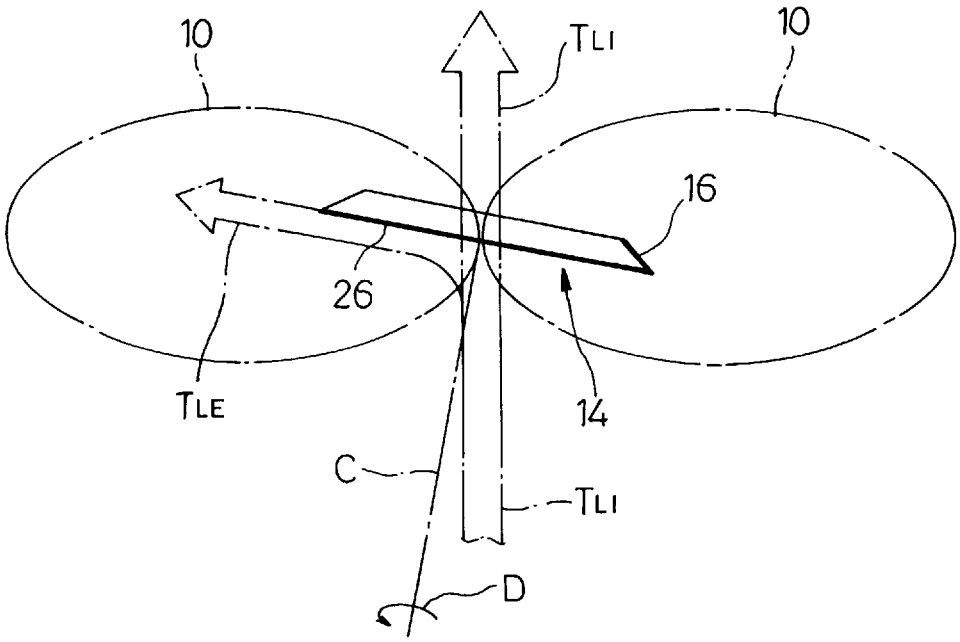
FIG. 3 is a view in the direction III of FIG. 1.

The trimming device further comprises a peeler disk 14 made of metal. The peeler disk 14 is rotatably provided directly under the pair of trimming disks 10. More specifically, the peeler disk 14 is disposed oblique to a horizontal plane, and an angle θ formed by the peeler disk 14 and the trimming disks 10 is set to 15°~45°, for example. It is to be noted that the peeler disk 14 is so inclined that the upper portion of the peeler disk 14 is located at the upstream side relative to the transportation direction A of the shredded tobacco layer $T_{LO}$, while the lower portion thereof is at the downstream side. As seen in FIG. 1, the peeler disk 14 is trapezoidal in cross section and has a taper surface 16 on the periphery thereof. The taper surface 16 tapers toward the lower surface of the trimming disk 10. It is so arranged that the taper surface 16 is in line contact with the lower surfaces of the pair of trimming disks 10 at its upper portion. Therefore, as the peeler disk 14 rotates, the taper surface 16 moves while keeping contact with the lower surfaces of the pair of trimming disks 10 in the area where the peripheral edge portions of the pair of the trimming disks 10 are close to each other. The taper surface 16 moves in the direction intersecting the transportation direction A of the shredded tobacco layer $T_{LO}$. That is, as seen in FIG. 3, the axis of rotation C of the peeler disk 14 intersects the perpendicular plane including a transportation axis of the shredded tobacco layer $T_L$ at a predetermined angle.

The peeler disk 14 is mounted on one end of a rotary shaft 18, while the other end of the rotary shaft 18 is connected to a power transmission system (not shown). Thus, torque is supplied from the power transmission system to the rotary shaft 18, thereby to rotate the peeler disk 14 in the direction D. The power transmission system supplies torque also to the pair of band rollers 4 of the suction band 2 and the pair of trimming disks 10.

Figure 4:
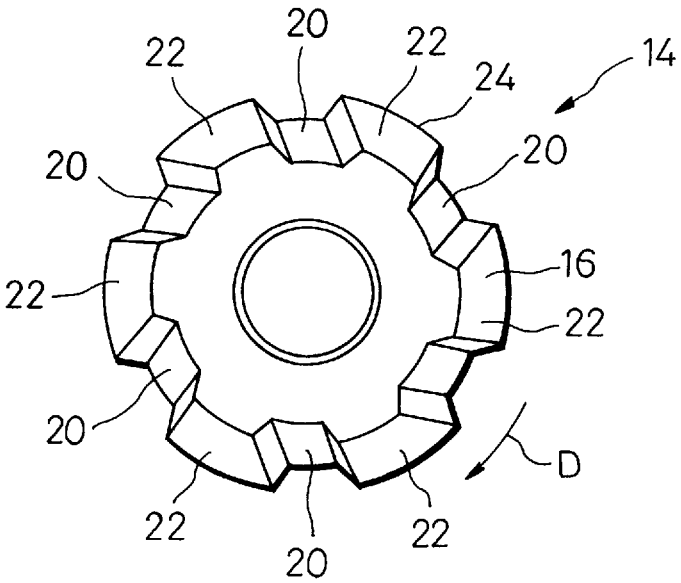
FIG. 4 is a front view of the peeler disk.

FIG. 4 shows the peeler disk 14 in detail. The taper surface 16 of the peeler disk 14 is not a smooth continuous surface, but is formed with a plurality of transverse recesses 20. The transverse recesses 20 are disposed equally spaced apart from one another in the peripheral direction of the peeler disk 14, so that the taper surface 16 has a plurality of land portions 22. As illustrated, if the trimming disks 10 have respectively six pockets 12, the taper surface 16 is formed with six transverse recesses 20 and six land portions 22. The transverse recesses 20 have a bottom surface arranged on the same circular plane.

As the peeler disk 14 rotates, the transverse recess 20 and the land portion 22 of the taper surface 16 pass the area where the peripheral edge portions of the pair of trimming disks 10 are close to each other, alternately and periodically. At that time, each transverse recess 20 periodically meets a corresponding pair of pockets 12 formed to the pair of trimming disks 10, respectively. Thus, the pair of trimming disks 10 can rotate without their pockets 12 interfering with the peeler disk 14. More specifically, in order to prevent the interference with the pockets 12, each transverse recess 20 is formed, as seen in FIG. 4, oblique to the axis of rotation C of the peeler disk 14 by a predetermined angle, assuring that an open end of the transverse recess 20 opening to the side of the small-diameter end face of the peeler disk 14 precedes the opposite open end thereof with respect to the direction of rotation D of the peeler disk 14. Each transverse recess 20 has a predetermined width in the peripheral direction of the peeler disk 14, and a depth equal to the distance between the upper surface of the trimming disk 10 and the lower surface of the pocket 12. The aforementioned oblique formation of each transverse recess 20 allows the transverse recess 20 to have a minimum width.

The peripheral edge at the side of the large-diameter end face of the peeler disk 14 is formed as a peeling blade 24 continuously extending in the peripheral direction of the peeler disk 14. More specifically, the peeling blade 24 includes the edges of the land portions 22 and the edges defining the open ends of the transverse recesses 20. Therefore, the distance between the axis of the peeler disk 14 and the peeling blade 24 varies periodically in the peripheral direction of the peeler disk 14.

The aforementioned pair of trimming disks 10 and the peeler disk 4 are supported in the manner that they can be moved in connection with each other in the perpendicular direction, or instead, the suction band 2 is so provided that a portion thereof located over the pair of trimming disks 10 can be raised and lowered. Thus, the distance between the suction band 2 and the pair of trimming disks 10 is adjustable.

The operation of the aforementioned trimming device 8 will be described hereinafter.

When the shredded tobacco layer $T_{L0}$ is formed on the suction band 2, the pair of trimming disks 10 and the peeler disk 14 are rotating. The peeler disk 14 rotates with its peeling blade 24 kept in contact with the lower surfaces of the peripheral edge portions of the trimming disks 10.

When the suction band 2 having the shredded tobacco layer $T_{L0}$ sucked thereon travels forth and passes the trimming device 8, the peripheral edge portions of the pair of trimming disks 10 cut into the shredded tobacco layer $T_{L0}$ and divide the shredded tobacco layer $T_{L0}$ into upper and lower portions. At the same time, the peeling blade 24 of the peeler disk 14, which rotates keeping contact with the lower surfaces of the peripheral edge portions of the trimming disks 10 (including the lower surfaces of the pockets 12), scrapes the lower portion of the shredded tobacco layer $T_{L0}$ off the lower surfaces of the trimming disks 10. Thus, the surplus portion of the shredded tobacco layer $T_{L0}$ is removed from the shredded tobacco layer $T_{L0}$ in the form of a peel-like layer.

The surplus shredded tobacco $T_{LE}$ scraped off the shredded tobacco layer $T_{L0}$ collides with the large-diameter end face 26 of the peeler disk 14 (FIG. 3) and is guided thereby obliquely downward. More specifically, when the surplus shredded tobacco $T_{LE}$ collides with the large-diameter end face 26, the rotation of the large-diameter end face 26 gives the kinetic vector having an obliquely downward direction from the side of the suction band 2 to the surplus shredded tobacco $T_{LE}$. Thus, the surplus shredded tobacco $T_{LE}$ flows guided by the large-diameter end face 26, and is discharged downward from the periphery of the peeler disk 14.

Since the peeler disk 14, or more specifically, the peeling blade 24 thereof is disposed oblique to the transportation direction of the shredded tobacco layer $T_{L0}$, the peeling blade 24 can easily cut into the shredded tobacco layer $T_{L0}$, and the surplus shredded tobacco is smoothly scraped off.

The surplus shredded tobacco $T_{LE}$ is thereafter collected by collecting means (not shown) and reused to form a shredded tobacco layer $T_{L0}$.

After the shredded tobacco layer $T_{L0}$ passes the pair of trimming disks 10, the shredded tobacco layer remaining on the lower surface of the suction band 2, that is, the trimmed shredded-tobacco layer $T_{L1}$ is adjusted in its thickness correctly to the distance between the trimming disks 10 and the suction band 2. On the other hand, while the pair of trimming disks are rotating, a pair of pockets 12 meet each other periodically in the shredded tobacco layer $T_{L0}$ as mentioned above, so that thickened portions $T_{LH}$ having a thickness increased by an amount corresponding to the content of the pair of pockets 12 are periodically formed to the trimmed shredded-tobacco layer $T_{L1}$ (FIG. 1). The thickened portion $T_{LH}$ are formed spaced apart from each other by a distance corresponding to twice a length of a cigarette, for example.

The shredded tobacco layer $T_{L1}$ is thereafter supplied from the suction band 2 to the wrapping section of the cigarette manufacturing machine as mentioned above. The shredded tobacco layer $T_{L1}$ supplied to the wrapping section is wrapped in the paper (not shown) as known, whereby a tobacco rod is formed continuously. The formed tobacco rod is supplied from the wrapping section to a cutting section of the cigarette manufacturing machine, where the tobacco rod is cut at the center of each portion corresponding to the aforementioned thickened portion, thereby to be separated into double-cigarettes.

As described above, in the trimming device 8, the shredded tobacco layer $T_{L0}$ is trimmed in the manner that the surplus shredded tobacco $T_{LE}$ is removed from the shredded tobacco layer $T_{L0}$ like peel is peeled off. Therefore, the surplus shredded tobacco $T_{LE}$ will not be subjected to a large load. Further, since the surplus shredded tobacco $T_{LE}$ flows guided by the large-diameter end face 26 of the peeler disk 14, the surplus shredded tobacco $T_{LE}$ will not be subjected to a large impact. Furthermore, since the surplus shredded tobacco $T_{LE}$ is discharged downward from the periphery of the peeler disk 14, the surplus shredded tobacco $T_{LE}$ can be collected easily. Thus, the surplus shredded tobacco $T_{LE}$ can be well protected from fragmentation so that the rate of reuse of the surplus shredded tobacco $T_{LE}$ is enhanced, while the transportation speed of the shredded tobacco layer is allowed to be increased. Therefore, the production efficiency of the tobacco rod can be enhanced.

The present invention is not limited to the above described embodiment, but various modifications can be made thereto. For example, the axis of rotation of the peeler disk 14 may extend within the perpendicular plane including the axis of the suction band 2. In that case, the peeling blade 24 of the peeler disk 14 moves in the direction orthogonal to the transportation direction A of the shredded tobacco layer $T_{L1}$ and scrapes the surplus shredded tobacco off the lower surface of the trimming disks 10.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A device for trimming a shredded tobacco layer formed in a cigarette manufacturing machine, comprising:

a trimming disk rotatably arranged in a vicinity of a suction band which forms and transports the shredded tobacco layer, said trimming disk continuously cutting into the shredded tobacco layer during the rotation thereof, thereby dividing the shredded tobacco layer into a required layer portion and a surplus portion; and removing means for removing the surplus portion of the shredded tobacco layer in cooperation with said trimming disk, said removing means including a rotatable peeling disk, said peeling disk having a peeling blade formed at a peripheral edge portion thereof to extend continuously in a peripheral direction, said peeling blade being movable in a plane inclined with respect to a lower surface of the trimming disk while keeping contact with the lower surface of said trimming disk, and a flat end face for guiding the removed surplus portion.

2. The device according to claim 1, wherein said peeling disk further includes a taper surface formed on a periphery of said peeling disk and arranged to be generally in parallel with the lower surface of said trimming disk, and a peripheral edge of a large-diameter side of said taper surface being formed as said peeling blade.

3. The device according to claim 2, wherein said peeling blade passes through the shredded tobacco layer, while moving in a direction obliquely crossing a transportation direction of the shredded tobacco layer.

4. The device according to claim 3, wherein said peeling disk has a plurality of transverse recesses on said taper surface, and said transverse recesses are disposed equally spaced apart from one another in the peripheral direction of said peeling disk.

* * * * *